US007138643B2

(12) United States Patent
Lewis et al.

(10) Patent No.: US 7,138,643 B2
(45) Date of Patent: Nov. 21, 2006

(54) METHOD AND APPARATUS FOR SEPARATING IONS OF METALLIC ELEMENTS IN AQUEOUS SOLUTION

(75) Inventors: Robert E. Lewis, Milford, NH (US); Fu-Min Su, Seattle, WA (US); Timothy A. Lane, Salem, NH (US); Keith R. Olewine, Merrimack, NH (US); Peter S. Holton, Lexington, MA (US)

(73) Assignee: Bristol-Myers Squibb Pharma Company, Princeton, NJ (US)

( * ) Notice: Subject to any disclaimer, the term of this patent is extended or adjusted under 35 U.S.C. 154(b) by 457 days.

(21) Appl. No.: 10/762,990

(22) Filed: Jan. 22, 2004

(65) Prior Publication Data

US 2004/0164025 A1 Aug. 26, 2004

Related U.S. Application Data

(63) Continuation-in-part of application No. 10/321,333, filed on Dec. 17, 2002.

(60) Provisional application No. 60/341,688, filed on Dec. 18, 2001.

(51) Int. Cl.
*G21G 1/02* (2006.01)

(52) U.S. Cl. ..... 250/432 PD; 423/2; 252/645; 424/1.1; 210/682

(58) Field of Classification Search ..... 250/432 PD; 423/2; 252/645; 424/1.1; 210/682
See application file for complete search history.

(56) References Cited

U.S. PATENT DOCUMENTS

| | | | | |
|---|---|---|---|---|
| 3,993,538 | A | 11/1976 | Lebowitz et al. | 176/11 |
| 5,368,736 | A | 11/1994 | Horwitz et al. | 210/635 |
| 5,512,256 | A | 4/1996 | Bray et al. | 423/2 |
| 6,309,614 | B1 | 10/2001 | Horwitz et al. | 423/2 |

OTHER PUBLICATIONS

Achuthan, P.V., et al., "Separation of carrier-free $^{90}$Y from high level waste by extraction chromatographic technique using 2-ethylhexyl-2-ethylhexyl phosphonic acid (KSM-17)," *Separation Science and Technology*, 2000, 35(2), 261-270.

Campbell, J.A., et al., "A generator system for thallium-201," *J. Labelled Compounds and Radiopharmaceuticals*, 1977, 13(3), 437-443.

Case, N., et al., *ORNL Radioisotope Manual, U.S.A.E.C. Report*, 30th Ed., Jun. 1964, ORNL-3633, TID 4500, 1-212.

Chmutova, M.K., et al., "Extraction of transplutonium elements with diphenyl (alkyl-carbamoylmethyl phosphine oxides," *J. Radioanal. Chem.*, 1983, 80(1-2), 63-69.

Chmutova, M.K., et al., "Extraction and concentration of transplutomium elements from nitric acid solutions by diphenyl [dialkylcarbamoylmethyl] phosphine oxides," *Sov. Radiochem. Eng. Transl.*, 1982, 24, 27-33.

Database WPI, "Separate radioactive nuclide solution treat active carbon chelate ion exchange resin," JP 57 048699 A, *Derwent Publications Ltd.*, London, Mar. 20, 1982, XP002237684 (abstract), 1 page.

Database WPI, "Scandium extract titanium tetra chloride produce waste treat waste solution reduce agent alkaline reagent filter dissolve residue hydrochloric acid contact solid neutral organo phosphorus extract," RU 2 068 392, *Derwent Publications Ltd.*, London, Oct. 27, 1996 (AN-1997), XP-002237685 (abstract), 1 page.

de Britto, J.L.Q., et al., "A new production method for carrier-free $^{201}$Tl using IEN's cyclotron in Rio De Janeiro," *J. Radioanal. Nucl. Chem. Letters*, 1985, 96(2), 181-186.

Deqian, L., et al., "Extraction separation of rare earth elements, scandium and thorium with mono (2-ethyl hexyl) 2-ethyl hexyl phosphonate (HEH(EPH))," *Int. Solvent Extr. Conf.*, 1980, 3, 80-202, 1-10.

Deqian, L., et al., "Chemical problems and extraction mechanism in technology of extraction separation of rare earth elements (III) with mono (2-ethyl hexyl)2-ethyl hexyl phosphonate," *New Frontiers in Rare Earth Science and Applications*, Guangxian, X. (Ed.), 1985, 1, 463-467.

Gatrone, R.C., et al., "The synthesis and purification of the carbamoylmethylphosphine oxides," *Solvent Extr. and Ion Exch.*, 1987, 5(6), 1075-1116.

(Continued)

*Primary Examiner*—Steven J Bos
(74) *Attorney, Agent, or Firm*—Woodcock Washburn LLP

(57) ABSTRACT

Methods and apparatus for separating ions of metallic elements are provided. Preferred methods utilize a hydrophobic chelating extractant, such as an organophosphorus compound, adsorbed onto carbon or graphite fibers in the form of felt. Also described is a new thallium-201 generator that comprises a column containing an acidic organophosphorus extractant adsorbed on carbon or graphite fibers, and a yttrium-90 generator system comprised of two extraction columns designed to selectively absorb yttrium-90 at different pH, to enable the separation of yttrium-90 from strontium-90. The two columns are connected in series for stepwise separation. The yttrium-90 product is freed from residual strontium-90 and metal contaminants and can be eluted from the second column with dilute acid, acetate buffer, water or saline for labeling biological targeted molecules. The new generator system provides rapid and efficient separation of yttrium-90 and is amenable to both scale-up and automation. Also described is a new $^{99m}$Tc generator that comprises a column containing an acidic organophosphorus extractant adsorbed on carbon or graphite fibers designed to selectively absorb $^{99}$Mo at a selected pH, to enable the separation of $^{99m}$Tc from $^{99}$Mo.

7 Claims, 1 Drawing Sheet

OTHER PUBLICATIONS

Horwitz, E.P., et al., "Octyl(phenyl)-N,N-diisobutylcarbamoylmethylphosphine oxide as an extractant for actinides from nitric acid waste," *ISEC'83, International Solvent Extraction Conference*, Aug. 26-Sep. 2, 1983, 451-452.

Horwitz, E.P., et al., The truex process—a process for the extraction of the transuranic elements from nitric acid wastes utilizing modified purex solvent, *Solvent Extr. Ion Exch.*, 1985, 3(1-2), 75-109.

Horwitz, et al., "Selected alkyl(phenyl)-N,N-dialkylcarbamoylmethylphosphine oxides as extractants for Am(III) from nitric acid media," *Sep. Sci. Technol.*, 1982, 17(10), 1261-1279.

Inoue, K., et al., *Nippon Kogyo Kaishi*, 1984, 102, 491-494 (English Abstract on p. 494).

Jackson, P.T., et al., "Intermolecular interactions involved in solute retention on carbon media in reversed-phase high-performance liquid chromatography," *Anal. Chem.*, 1997, 69, 416-425.

Lagunas-Solar, M.C., et al., "An integrally shielded transportable generator system for thallium-201 production," *Int. J. Appl. Radiat. Isot.*, 1982, 33, 1439-1443.

Malinin, A.B., et al., "Production of "no-carrier-added" $^{201}$Tl," *Int. J. Appln. Radiat. Isot.*, 1984, 35, 685-687.

Mathur, J.N., et al., "Partitioning of actinides from high-level waste streams of purex process using mixtures of CMPO and TBP in dodecane," *Waste Management*, 1993, 13, 317-325.

Mathur, J.N., et al., "Extraction of actinides and fission products by octyl(phenyl)-N,N-diisobutylcarbamoylmethyl-phosphine oxide from nitric acid media," *Talanta*, 1992, 39(5), 493-496.

Medved, T.Y., et al., "Oxides of dialkyl (diaryl) [dialkylcarbamoylmethyl] phosphines," Bulletine of the *Acad.of Sci.of the U.S.S.R., Chem. Science*,Sep. 1981, 1743-1746.

Mori, Y., et al., "Extraction equilibrium and kinetics of some lanthanoid with acidic organophosphorus extractants," *Proc. Symp. Solvent Extr.*, Jpn. Assoc. Solvent Extr. Hamamatsu, Japan, 1984, 119-124.

Muscatello, A.C., et al., "Synergistic extraction of plutonium and americium by bifunctional organophosphoric reagents," *ISEC'83 International Solvent Extraction Conference*, Aug. 26-Sep. 2, 1983, p. 72-73.

Muscatello, A.C., et al., "The extraction of Am(III) and Eu(III) from aqueous ammonium thiocyanate by dihexyl-N,N-diethylcarbamoylmethylphosphonate and related compounds," *Sep. Sci. Technol.*, 1982, 17(6), 859-875.

Navratil, J.D., "Recent advances in americium processing chemistry," *Rockwell International Conference on Nuclear and Radiochemistry* (*ICNR '86*) (*papers in summary form only received*), Sep. 1-5, 1986, XP008015781, 1 page.

Nuñez, L., et al., "Transuranic separation using organophosphorus extractants adsorbed onto superparamagnetic carriers," *J. Magnetism and Magnetic Materials*, 1999, 194, XP-002237682, 102-107.

Patridge, J.A., et al., "Purification of DI-(2-ethylhexyl)phosphoric acid by precipitation of copper(II) di-(2-ethylhexyl)phosphate," *J. Inorg. Nucl. Chem.*, 1969, 31, 2587-2589.

Peppard, D.F., et al., "Fractional extraction of the lanthanides as their di-alkyl orthophosphates," *J. Inorg. Nucl. Chem.*, 1957, 4, 334-343.

Peppard, D.F., et al., "Acidic esters of phosphonic acid as selective extractants for metallic cations-selected M(III) tracer studies," *J. Inorg. Nucl. Chem.*, 1961, 18, 245-258.

Peppard, D.F., et al., "DI n-OCTYL phosphinic acid as a selective extractant for metallic cations," *J. Inorg. Nucl. Chem.*, 1965, 27, 2065-2073.

Qaim, S.M., et al., "Production of $^{201}$Tl and $^{203}$Pb via proton induced nuclear reactions on natural thallium," *Int. J. Appl. Radiat. Isot.*, 1979, 30, 85-95.

Shadrin, A.Y., et al., "Extraction with the solution of diphenyl [dibutylcarbamoyl-metyl] phosphine oxide in polar solvent," *Nuclear Materials Technology and Nuclear Fuel Cycle*, Sep. 14, 1992, 281-283.

Shultz, W.W., et al., "Recent progress in the extraction chemistry of acitnide ions," *J. Less-Common Metals*, 1986, 122, 125-138.

Warf, J.C., "Extraction of cerium(IV) nitrate by butyl phosphate[Ia]," *J. Am. Chem. Soc.*, Sep. 1949, 71, 3257-3258.

Wilke, J.S., et al., "Chemistry for commercial scale production of yttrium-90 for medical research," *Appl. Radiat. Isot.*, 1990, 41(9), 861-865.

Campbell, J.A., "A generator system for thallium-201," *J. of Labelled Compounds and Radiopharmaceuticals*, 1977, 13(3), 437-443.

Lebowitz, E., et al., "Thallium-201 for medical use. I," *J. of Nucl. Med.*1975, 16(2), 151-155.

Malinin, A.B., et al., "Production of "No-Carrier-Added" $^{201}$T1," *Int. J. Appl. Radiat. Isot.*, 1984, 35(7), 685-687.

SEPARATION OF YTTRIUM-90 FROM STRONTIUM-90

METHOD AND APPARATUS FOR SEPARATING IONS OF METALLIC ELEMENTS IN AQUEOUS SOLUTION

CROSS REFERENCE TO RELATED APPLICATIONS

This application is a Continuation-In-Part of U.S. application Ser. No. 10/321,333, filed Dec. 17, 2002, which claims priority to U.S. Provisional Application Ser. No. 60/341,688, filed Dec. 18, 2001, each of which is incorporated herein by reference in its entirety.

FIELD

This invention is generally directed to methods and apparatus for separating ions of metallic elements in aqueous solution by chromatography. The elements to be separated may belong to the same or to different Groups in the long periodic table, including main group elements, transition metals, lanthanides and actinides. The present invention relates more particularly to an apparatus and a method for separating ions of radioisotopes such as $^{90}$Y, $^{201}$Tl, and $^{99m}$Tc from their parent elements, and producing multicurie levels of same for medical applications while generating minimum waste.

BACKGROUND

Radioactive isotopes of many metallic elements have potential uses in the diagnosis and treatment of disease. The yttrium-90 isotope, for example, which has a half-life of 64 hours and emits a strong beta particle (Emax=2.28 MeV), has excellent promise in treating many human diseases, and recent advances in radioimmunotherapy and peptide targeted radiotherapy have created a great demand for $^{90}$Y. Another radioisotope, thallium-201, which has a half-life of 73 hours and emits photons of 135 and 167 keV, is widely used as a myocardial perfusion imaging agent. Numerous other examples of radioactive isotopes, and their potential use as radiopharmaceuticals are well known to those in the art.

One way to produce radioisotopes with potential use as radiopharmaceuticals is from the decay of radioactive species of elements from adjacent groups in the periodic table. For Example, $^{90}$Y can be produced from the 28-year half-life decay of $^{90}$Sr. Similarly, $^{201}$Tl is decayed from its parent $^{201}$Pb ($T_{1/2}$=9.33 hour).

To be used as radiopharmaceuticals, the target isotopes generally need to be separated from the parent compounds. Many different techniques have been used to separate radioisotopes, including precipitation, solvent extraction, and ion-exchange chromatography, and the use of a number of organophosphorus extractants has been described. For example, di-2-ethylhexylphosphoric acid (DEHPA) has been widely used in extraction technology of rare earths and yttrium since the publication of Peppard, et al. (D. F. Peppard, et al., J. Inorg. Nucl. Chem. 4: 334, 1957) in 1957. DEHPA was also used in high level separations of fission products of rare earths and $^{90}$Y at Oak Ridge National Laboratory in 1959. A smaller scale procedure for millicurie quantities of $^{90}$Y was used at Oak Ridge National Laboratory (ORNL) (N. Case, et al., ORNL Radioisotope Manual, U.S.A.E.C. Report ORNL-3633, TID 4500, 30$^{th}$ edition, June 1964) from 1962 to 1990. This procedure was later modified for use in purification of reagents and is now used commercially to supply $^{90}$Y (J. A. Partridge, et al., J. Inorg. Nucl. Chem. 31: 2587–89, 1969; and Lane A. Bray, et al., U.S. Pat. No. 5,512,256, Apr. 30, 1996).

Another organophosphorus compound, 2-ethylhexyl 2-ethylhexylphosphonic acid (EHEHPA), was also developed by Peppard (D. F. Peppard, et al., J. Inorg. Nucl. Chem. 18: 245, 1961 and J. Inorg. Nucl. Chem. 27: 2065, 1965). This extractant became widely used to recover yttrium, other rare earths and trivalent actinides, because it was readily stripped with dilute acid. Several investigators have reported a specific preference for EHEHPA over DEHPA for yttrium recovery (Y. Mori, et al., Proc. Symp. Solvent Extr. 119–24, Jpn. Assoc. Solvent Extr. Hamamatsu, Japan, 1984; K. Inoue, et al., Nippon Kogyo Kaishi, 102: 491–4,1984; D. Li, et al., Int. Solvent Extr. Conf. (proc.) 3: 80–202, 1980; D. Li, et al., New Frontiers in Rare Earth Science and Applications, 1: 463–67, 1985; and P. V. Achuthan, et al., Separation Science and Technology, 35: 261–270, 2000).

The use of neutral organophosphorus compounds for recovery and purification of uranium, actinides and rare earths began in the 1950's (J. C. Warf, J. Am. Chem. Soc. 71: 3257, 1949) with tri-n-butyl phosphate (TBP). Other extractants with phosphine groups were tested in the 1960–70's with some success. The work at Argonne National Laboratory (R. C. Gatrone, et al., Solvent Extr. and Ion Exch. 5: 1075–1116, 1987) in developing a number of compounds of the carbamoylmethylphosphine oxides type led to a class of extractants for removing trivalent, quadri-valent and hexavalent ions from nitric acid solutions. A number of papers from Argonne National Laboratory and from USSR in the 1980–83 period also demonstrated the use of the this type of extractant (D. G. Kalina, et al, Sep. Sci. Technol. 17: 859, 1981; T. Y. Medved, et al., Acad. Sci. U.S.S.R., Chem. Series, 1743, 1981; E. P. Horwitz, et. al., Sep. Sci. Technol. 17: 1261, 1982; M. K. Chmutova, et al., Sov. Radiochem. Eng. Transl. 24: 27, 1982; E. P. Horwitz, et al., Proceedings ISEC'83 1983; M. K. Chmutova, et al., J. Radioanal. Chem. 80: 63, 1983; A. C. Muscatello, et al., Proceedings ISEC'83, pp. 72, 1983; E. P. Horwitz, et al., Solvent Extr. Ion Exch. 3: 75, 1985; W. W. Shultz, et al., J. Less-Common Metals, 122: 125, 1986; J. N. Mathur, et al., Talanta, 39: 493–496, 1992; J. N. Mathur, et al., Waste Management, 13: 317–325, 1993). When using this technique, the ions are extracted as the metal nitrates from nitric acid solution. The extractants, loaded with the ions, are then back extracted with dilute acids or salt solutions (0.01–0.1N), which causes the ions to strip from the extractant, thereby permitting easy recovery without boil-down of the acids.

As noted above, $^{201}$Tl is produced by decay (electron capture) of its parent isotope, $^{201}$Pb. $^{201}$Pb is generally produced in a cyclotron by irradiating $^{203}$Tl with ~30 MeV protons ($^{203}$Tl(p, 3n)$^{201}$Pb). Separation of $^{201}$Tl from the irradiated targets is traditionally performed in two steps. First, radioactive lead is separated from the $^{203}$Tl targets, and after an optimal waiting period to allow build up, the accumulated $^{201}$Tl daughter is separated from the parent lead isotopes. Various methods for performing the separation have been reported. E. Lebowitz, et al., J, Nucl. Med., 16:151–155 (1975), for example describes a production method in which EDTA complexing agent, hydrazine sulfate and a ion exchange column are first used to separate the lead activities from the thallium targets. Next, an anion exchange column is used to adhere the $^{201}Tl^{+3}$ (oxidated by NaClO) and allow the lead activities to be eluted. Finally the $^{201}$Tl activity is then eluted with hot hydrazine-sulfate solution, reducing $Tl^{+3}$ to $Tl^{+1}$. S. M. Qaim, et al., Int J. Appl. Radiat. Isot., 30: 85–95, 1979, reported a procedure of precipitating quantitatively the carrier-free lead activities by $Fe(OH)_3$ first, followed by an anion-exchange column separation of $^{201}$Tl. M. D. Kozlova, et al., Int J. Appl. Radiat. Isot., 35: 685–687, 1984, reported a procedure that includes the co-precipitation of the lead activities as strontium sulfate, followed by solvent extraction using butyl acetate and adding $KBrO_3$ solution. J. L. Q. de Britto, et al., J. Radioanal. Nucl. Chem. Letters, 96: 181–186, 1985, reported a separation based on the properties of a chelating caboxylic acid ion exchange resin-column which at pH 4.5 retains lead while thallium is easily eluted. Both J. A. Campbell, et al., (J. Labelled Compounds and Radiopharmaceuticals, 13:437–443, 1977) and M. C. Lagunas-Solar, et al., (Int J. Appl. Radiat. Isot., 33: 1439–1443, 1982) suggested to use Dowex 50W-X8 system to adsorb lead and thallous ion, while thallic ion is eluted by 0.005N hydrochloric acid containing 0.1% chlorine gas. These methods all tend to be time consuming, hazardous, and expensive.

To be suitable for use in radiopharmaceuticals, it is also generally important for the radioisotope to be separated from the parent compounds to a high degree of purity. For example, for products containing $^{90}$Y, the level of $^{90}$Sr should be kept below $10^{-6}$Ci per Ci $^{90}$Y. Contamination by other metals such as Fe, Cu, Zn, and Ca should also be reduced, because the foreign metallic ions can compete with $Y^{+3}$ for chelating agents that may be used in the pharmaceutical products. However, many different techniques for the separation of radioisotopes suffer from incomplete separation, and/or contamination by other metals. Consequently, the prior art has failed to provide a simple separation process for producing quality radioisotopes that meet these criteria.

Also, many of the known techniques have deficiencies in scaling up the separation process due to radiation damages to the materials and devices used in the separation. For example, J. S. Wike, et al., Appl. Radiat. Isot., 41: 861–865, 1990, discloses a separating technique using DEHPA in dodecane to extract $^{90}$Y. However, the complexity of the process, which involves repeated stripping of the organic extractant, leads to the accumulation of radiolysis products of the extractant in either the $^{90}$Sr stock solution or $^{90}$Y product. It is believed that both the DEHPA and radiolytic fragments of organic extractant cause the $^{90}$Y to stick to the wall of glass vessels used in the process, resulting in poor recovery of $^{90}$Y. Consequently, this method fails to provide a simple $^{90}$Sr/$^{90}$Y separation process for producing quality $^{90}$Y in high yields.

Horwitz, et al., U.S. Pat. No. 5,368,736, discloses another separation technique that is capable of producing high decontamination factor of $^{90}$Y. This technique involves immobilizing strontium-selective extractant of hydrophobic crown ether carboxylic acid onto polymeric resin to selectively strip $^{90}$Sr away from $^{90}$Y after passing a $^{90}$Sr/$^{90}$Y mixture through the crown ether column. The $^{90}$Y effluent is further purified by resin that is impregnated with rare-earth selective extractant, which is a mixture of octyl-(phenyl)-N,N-diisobutylcarbamoylmethylphosphine oxide (CMPO) and tri-butyl phosphate (TBP). The above separation technique avoids the use of organic solvent but requires at least three strontium-selective columns for the complete retention of $^{90}$Sr, which may limit its potential for multicurie scale-up. In addition this technique requires pH adjustment and volume concentration of $^{90}$Y between the crown ether and CMPO/TBP columns, which further complicate the process at the multicurie level.

Another present commercial method for supplying $^{90}$ y involves the extraction of $^{90}$Y from a mixture of $^{90}$Y and $^{90}$Sr using a DEHPA solvent extraction process that requires high concentrations of $HNO_3$ or HCl (8–10 N) to strip the $^{90}$Y. When the excess acid is evaporated, the $^{90}$Y recombine with trace amounts (1–2 mg/liter) of DEHPA in the $^{90}$ y product, which results in loss of product on glassware (J. S. Wike, et al., J. Appl. Radiat. Isot., 41: 861–5, 1990), and in the shipping container. The recombination of $^{90}$Y with trace amounts of DEHPA can also result in precipitates, and incomplete tagging of the targeted molecule with $^{90}$Y. Consequently, the prior art has failed to provide a simple $^{90}$Sr/$^{90}$Y separation process for producing quality $^{90}$Y in high yields.

What is needed is an improved method and apparatus for simple, low cost, separation of ions of metallic elements in aqueous solution, and, in particular, for separation of radioisotopes from their parent compounds. For example, a method that may be used to separate $^{90}$Y from $^{90}$Sr to provide $^{90}$Y ions with improved purity, concentrations and yields for use in radiotherapy. The process should also not require the use of any organic solvent, should minimize liquid waste discharge and also minimize waste of the radioactive parent

SUMMARY

In one embodiment of the invention, there is provided a method for separating ions of metallic elements in aqueous solution. The method comprises the steps of providing an ion exchange that comprises a carbon or graphite substrate impregnated with a hydrophobic chelating extractant. The extractant is one that has a greater affinity, at a selective pH, for ions of a first metallic element, than for ions of a second metallic element that is different than the first element. This method further entails the step of providing a solution that comprises ions of said first and second metallic elements, and contacting the solution with the ion exchange, at the selective pH, for a time sufficient for ions of said first element to become bound thereto.

Another embodiment of the invention provides an ion exchange that comprises a carbon or graphite substrate impregnated with a hydrophobic chelating extractant. The extractant is one that has a greater affinity, at a selective pH, for ions of a first metallic element, than for ions of a second metallic element that is different than the first element, and wherein said first element is bound to said extractant. The method further entails the step of providing a solution at a second selective pH and after a time sufficient for said second element to be produced from radioactive decay of said first element.

Another embodiment of the invention provides a method for separating ions of metallic elements in an aqueous acid solution by chromatography. This method comprises the following steps.

(A) Configuring a chromatographic system that comprises two separation columns. Each column contains an ion exchange having a greater affinity for ions of a first metallic element than for ions of a second metallic element at a selective pH. In this embodiment, the selective pH for the two ion exchanges is not the same.

(B) Providing a feed solution at the selective pH, wherein the feed solution comprises ions of the first and second metallic elements.

(C) Loading the feed solution onto the first separation column for a time sufficient to allow at least a portion of the first metallic element to bind to the first ion exchange.

(D) Eluting the first metallic ion from the first ion exchange with a solution having a pH at which the first ion exchange has substantially no affinity for the first metallic ion.

(E) The eluant from Step (D) may then optionally be adjusted to the second selective pH, at which the second ion exchange has an affinity for the first metallic element.

(F) The eluant is then loaded onto the second separation column for a time sufficient to allow at least a portion of the first metallic element to bind to the second ion exchange.

(G) A second eluant is prepared by eluting at least a portion of the first metallic ion from the second ion exchange with an aqueous solution that has a pH at which the second ion exchange has substantially no affinity for the first metallic ion.

In another embodiment of the invention, a separation column for separating metallic elements is provided. The separation column comprises:

(a) a body portion having both an inlet and an outlet;

(b) an ion exchange housed within the body portion, that comprises a carbon or graphite substrate impregnated with a hydrophobic chelating extractant that has a greater affinity, at a selective pH, for ions of a first metallic element than for ions of a second metallic element; and (c) a solution at the selective pH, that contains ions of the first and second metallic elements.

Yet another embodiment of the invention is a $^{201}$Tl generator comprising:

(a) a body portion having an inlet and an outlet;

(b) an ion exchange housed within the body portion.

The ion exchange comprises carbon or graphite fibers impregnated with an acidic organophosphorus extractant such as DEHPA, EHEHPA, or di(2,4,4-trimethylpentyl) phosphinic acid (DTMPPA). The ion exchange further comprises ions of $^{201}$Pb bound to the extractant.

Another embodiment of the invention is a $^{99m}$Tc generator comprising:

(a) a body portion having an inlet and an outlet;

(b) an ion exchange housed within the body portion.

The ion exchange comprises carbon or graphite fibers impregnated with an acidic organophosphorus extractant such as DEHPA, EHEHPA, or DTMPPA. The ion exchange further comprises ions of $^{99}$Mo bound to the extractant.

A further embodiment of the invention provides a chromatographic extraction system that comprises:

(a) a first column comprising:

(1) a first body portion having an inlet and an outlet;

(2) a first ion exchange housed within the body portion, wherein the first ion exchange has a greater affinity for ions of a first metallic element than for ions of a second metallic element at a first selective pH; and (b) a second column comprising:

(1) a second body portion having an inlet and an outlet, wherein the inlet of said second column is in flow communication with the outlet of said first column;

(2) a second ion exchange housed within the second body portion.

In this embodiment, the second ion exchange also has a greater affinity for ions of said first metallic element than for ions of a second metallic element, but at a different pH than the first selective pH.

In a further embodiment of the invention, there is provided a $^{90}$Y generator. This generator comprises:

(a) a first column comprising:

(1) a first body portion having an inlet and an outlet;

(2) a first ion exchange housed within the first body portion, wherein the first ion exchange comprises an acidic organophosphorus extractant;

(3) a feed solution within the first body portion and in contact with the first ion exchange, the feed solution comprising $^{90}$Sr ions and having a pH from about 1.5 to 2.5; and (b) a second column comprising:

(1) a second body portion having an inlet and an outlet, wherein the inlet of the second column is in flow communication with the outlet of the first column;

(2) a second ion exchange within the second body portion, the second ion exchange comprising a neutral or bifunctional organophosphorus extractant adsorbed onto a carbon or graphite substrate.

Additional embodiments of the invention will be readily apparent to those of ordinary skill in the art upon review of the instant application.

BRIEF DESCRIPTION OF THE DRAWINGS

The numerous objects and advantages of the present invention may be better understood by those skilled in the art by reference to the accompanying detailed description and the following drawing, in which.

DETAILED DESCRIPTION

Figure 1:
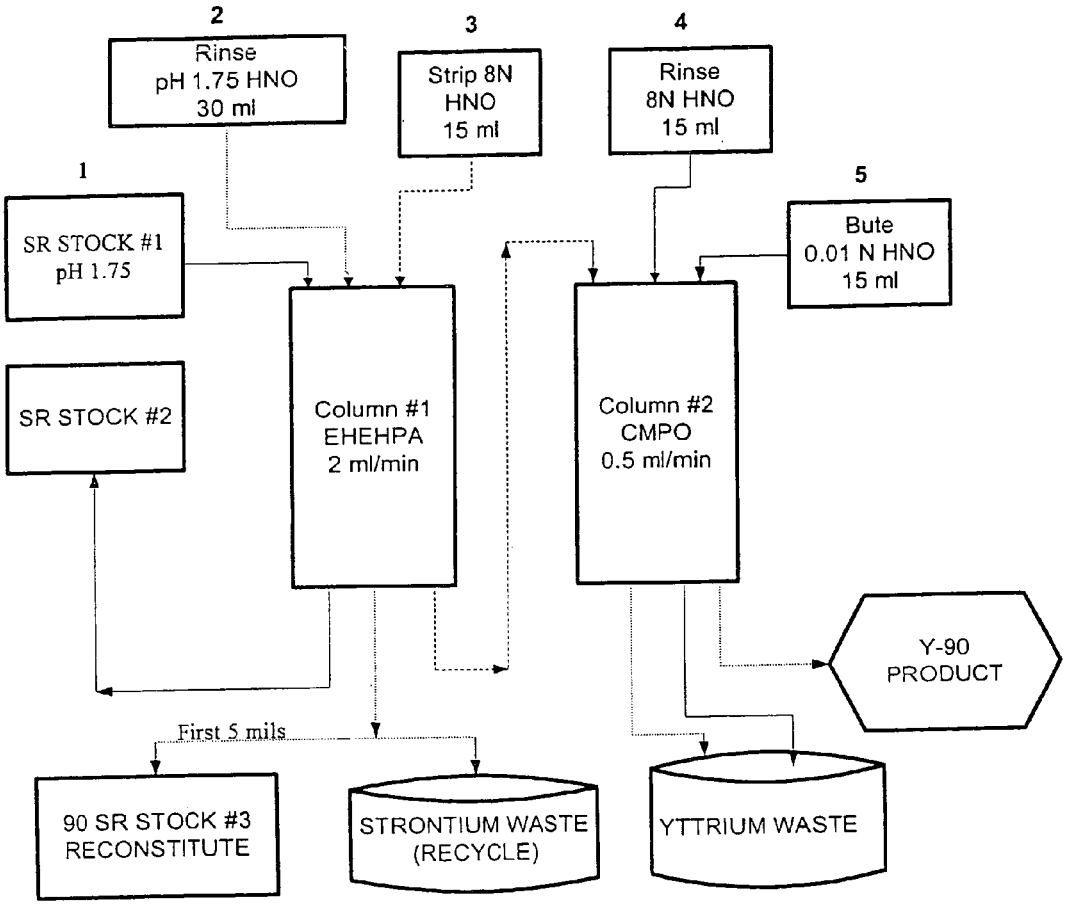
FIG. 1 is a schematic drawing of a process for separating $^{90}$Y from $^{90}$Sr.

The present invention provides improved methods and apparatus for separating ions of metallic elements in aqueous solution, thereby providing relatively pure samples of the desired metallic elements for use in a wide variety of applications in a wide number of industries, including mining, environmental decontamination, the pharmaceutical industry, and in the treatment and diagnosis of disease, to name but a few. Separation of ions is achieved with the use of ion exchanges that will preferentially bind ions of one element, while ions of another element remain in solution. As used herein, "separation" and "separating" means that at least about 90%, preferably greater than about 90%, more preferably greater than about 95% and even more preferably greater than about 99% of the ions of one metallic element present in the aqueous solution may be removed from the solution by the ion exchange, while at least about 90%, preferably greater than about 90%, more preferably greater than about 95% and even more preferably greater than about 99% of the ions of another, different metallic element remain in the aqueous solution. In preferred embodiments, solutions may be prepared in which a separation of greater than about $10^4$, more preferably greater than about $10^6$, and still more preferably about $10^8$ may be achieved. In other words, taking the separation of $^{90}$Y from $^{90}$Sr as an example, using the methods and apparatus described herein, it is possible to obtain a sample of purified $^{90}$Y in which the $^{90}$Sr/$^{90}$Y ratio is preferably less than about $10^{-6}$, and more preferably less than about $10^{-8}$.

In many applications, the methods and apparatus will be used to separate metallic elements belonging to different Groups in the long periodic table. However, the methods may be adapted to separate elements belonging to the same Group, as well. Groups in the long periodic table include main group elements, including Groups IA, IIA, IIIB, IVB, VB, VIB, transition metals, including Groups IIIA, IVA, VA, VIA, VIIA, VIIIA, IB, and IIB, Lanthanides, including elements with atomic atom from 57 to 71, and Actinides, including elements with atomic number from 89 to 103. Thus, suitable elements which may be separated using the methods and systems of the present invention include, for example, Li, Be, Na, Mg, Al, K, Ca, Sc, Ti, V, Cr, Mn, Fe, Co, Ni, Cu, Zn, Ga, Ge, Rb, Sr, Y, Zr, Nb, Mo, Tc, Ru, Rh, Pd, Ag, Cd, In, Sn, Sb, Cs, Ba, La, Hf, Ta, W, Re, Os, Ir, Pt, Au, Hg, Tl, Pb, Bi, Po, Fr, Ra, Ac, Ku, Ce, Pr, Nd, Pm, Sm, Eu, Gd, Tb, Dy, Ho, Er, Tm, Yb, Lu, Th, Pa, U, Np, Pu, Am, Cm, Bk, Cf, Es, Fm, Md, No, and Lw.

To achieve such ends, the present invention makes use of hydrophobic chelating extractants. Suitable extractants for use in the present invention include: acidic organophosphorus extractants, for example DEHPA, EHEHPA and DTMPPA; neutral organophosphorus extractants, for example TBP and tri-n-octylphosphine oxide (TOPO), bifunctional organophosphorus extractants, for example CMPO and N,N,N',N'-tetraoctyl-3-oxamentanediamide (TOGDA); basic extractants, for example tri-n-octylamine (TOA) and tricaprylmethylammonium chloride. Other extractants known to those of skill in the art may also be used, including hydroxyoximes, for example 5,8-diethyl-7-hydroxy-6-dodecane oxime and 2-hydroxy-5-nonylacetophenon oxime, crown ethers, for example di-t-butyldicyclohexano-18-crown-6, and dithiosemicarbazone.

Preferably, in the present invention the hydrophobic chelating extractant is adsorbed onto a substrate to provide an ion exchange. In preferred embodiments, the ion exchange is housed in a column. The column will have at least one inlet and at least one outlet. In two column systems, described more fully below, an outlet of the first column may be in flow communication with an inlet of the second column. Additional inlets and/or outlets may be present in either or both columns as well, to add or recover rinse solutions, excess feed solutions, and the like.

Although a wide variety of different substrates suitable for use in an ion exchange are known in the art, the inventors have discovered that substrates comprising carbon and graphite are particularly well suited to the methods and apparatus of the present invention. While it should not be construed as limiting the invention, it is thought that the hydrophobic interaction between the above-referenced extractants and carbon or graphite substrates is particularly strong, and does not interfere with the chelating portion of the extractants. The carbon and graphite substrates are also thought to have high stability in strong acids and bases, and may be more resistant than other types of substrates to the radiation fields that may be present when using the methods and apparatus of the present invention to separate radioactive metallic elements.

A variety of such carbon and graphite substrates may be used, including molded graphite and carbon, vitreous (glassy) carbon, pyrolytic graphite and carbon, carbon fibers, carbon composites, and carbon and graphite powders and particles. A common substrate for hydrophobic extractants is carbon coated inorganic materials prepared by decomposition of organic compounds in a 600° C. temperature gas stream, such as $ZrO_2$. It has been suggested that the bonding of organic ionophores to carbon-coated $ZrO_2$ involves not only hydrophobic attraction, but also involves electronic (pi—pi) interaction of the organic ionophore to the graphitic planer structure (Paul T. Jackson et. al, Anal. Chem. 69: 416–425, 1997). This strong bonding prevents leaching of the organic ionophore much better than is observed with polymeric matrixes, such as Chromosorb or XAD adsorbents, or materials coated with cross-linked polybutadiene.

Pure carbon or graphite fibers, formed at >1500° C., have been found to provide a very good substrate for most hydrophobic extractants commonly used in solvent extraction of the present invention, and are preferred in embodiments of the present invention that utilize carbon or graphite substrates. In preferred embodiments, the carbon or graphite fibers are in the form of carbon or graphite felt. Preferably, this carbon or graphite felt is used with no other substrate. The low bulk density of about 50 mg/cm$^3$ and high surface area (estimated at 30–40 m$^2$/gm) of this product, as well as the ability to selectively bind organophosphorus extractants, allows columns to be prepared that can be operated at fast flow rates, for example from about 1 to about 10 ml/cm$^2$/min, with good performance. Additionally, the felt is easy to cut and pack into columns, is easy to weigh, and adsorbs specific amounts of organophosphorus extractants more predictably than do powdery or granular materials.

Carbon or graphite felt suitable for use in the present invention may be obtained from commercial vendors (for example, from Fiber Materials, Inc. Biddeford, Me.) in the form of ⅛ inch thick sheets. These low density flexible felt materials are produced by the carbonization and graphitization of long, small diameter organic Rayon filaments at 2300° C. to produce a graphite felt with >99.7% purity. This material has only ppm amounts of Cu and S impurities. Preleaching with $HNO_3$ solutions removes these impurities. The felt is dried at 110° C., and then loaded with the desired extractants in methanol solutions. After drying in air, the graphite felt is cut in circular pads using a Shim cutter of a diameter equal to or slightly larger than the diameter of the column. Several graphite felt pads, for example from about 5 to about 15 or more, depending on the size of the column, may be used in each column and compressed slightly to remove any voids.

The inventors of the present invention have also discovered that the affinity of various chemical organophosphorus extractants for different metallic elements is pH-dependent. For example, organophosphoric acids of the general formula $(RO)_2P(O)(OH)$, such as DEHPA, organophosphonic acids of the general formula (RO)RP(O)(OH), such as EHEHPA, and organophosphinic acids of the general formula $R_2P(O)(OH)$, such as DTMPPA, have a marked affinity for $^{90}Y$ at relatively low acid concentrations and may thus be used to extract $^{90}Y$ from $^{90}Sr$ under these conditions. Similarly, we have found that DEHPA has an affinity for $^{201}Pb$ at pH greater than or equal to 2.5, and may thus be used to readily separate $^{201}Pb$ from $^{201}Tl$ in a solution having such a pH level. In the presence of concentrated acid solutions, however, acidic organophosphoric extractants lose their affinity for these ions. Thus, a concentrated acid solution, such as a concentrated solution of hydrochloric acid, perchloric acid, sulfuric acid or nitric acid, may be used to elute ions that became bound to the extractant at a higher pH. As used herein, the term "concentrated" when used with regard to an acid refers to a solution having an acid concentration of at least about 4N.

In contrast, we have found that other organophosphorus compounds, such as CMPO and TBP, require much higher acid concentrations to retain $^{90}Y$. Thus, in a concentrated acid solution, $^{90}Y$ becomes bound to CMPO, and the bound $^{90}Y$ may then be eluted from the extractant in the presence of a dilute acid solution. As used herein, the term "dilute" when used with regard to an acid solution, refers to a solution having an acid concentration of less than about 0.1N. The discovery of these unique chemical properties have allowed the inventors of the present invention to develop a process and apparatus to separate $^{90}Y$ from $^{90}Sr$ wherein the process requires no concentration (evaporation) and acidity adjustments between the column separation of $^{90}Y$ from $^{90}Sr$.

It has also been found that organophosphoric acids of the general formula $(RO)_2P(O)(OH)$, such as DEHPA, organophosphonic acids of the general formula (RO)RP(O)(OH), such as EHEHPA, and organophosphinic acids of the general formula $R_2P(O)(OH)$, such as DTMPPA have an affinity for $^{99}Mo$ at a pH from about 1 to about 2 and may thus be used to readily separate $^{99}Mo$ from $^{99m}Tc$ in a solution having such a pH level. In the presence of basic solutions, such as sodium hydroxide and ammonium hydroxide, however, these acidic organophosphoric extractants lose their affinity for $^{99}Mo$. Thus, a basic solution may be used to elute ions that became bound to the extractant at a lower pH.

In the present invention, an extractant is used that has a greater affinity for a ions of one metallic element, than for a second metallic element, optionally belonging to a different Group on the long periodic table, at a select pH. As used herein, "greater affinity" means that the affinity of the extractant for ions of the first metallic element, as compared to the affinity for elements of the second metallic element, is greater than about 10:1, preferably greater than about 100:1, more preferably greater than about 1000:1, and even more preferably greater than about 10,000:1.

In certain embodiments of the invention, the first metallic element is eluted from the extractant by a solution having a second pH, at which the extractant has substantially no affinity for ions of the first metallic element. As used herein, the term "substantially no affinity" means that at such a pH, at least about 75% of any bound ions will be eluted. Preferably, at such a pH at least about 85% of any bound ions will be eluted, and more preferably at least about 95% of any bound ions will be eluted. In particularly preferred embodiments greater than about 95%, and even greater than about 99% of any bound ions will be eluted.

If the loading of the column with substrate impregnated with extractant is too low, insufficient binding of the first metallic element may occur. If the loading is too heavy, incomplete elution from the extractant may result. Most preferably, the column is loaded with substrate impregnated with extractant to provide greater than about 99% retention of the first metallic element at the selective pH, and greater than about 97% elution of the first metallic element at the second pH. The loading concentration of the extractant is determined experimentally for each extractant, but typically varies from about 0.1 to about 1.0 grams extractant per gram of graphite felt. For example, in one embodiment of the present invention, the optimum loading for EHEHPA is about 0.1 gram per gram of carbon or graphite felt, and for CMPO is about 0.25 gram/per gram of carbon or graphite felt. In this embodiment, EHEHPA on graphite felt at pH 1.5–2.5 allowed $^{90}Y$ to be recovered from $^{90}Sr$ as $Sr(NO_3)_2$ solution at pH 1.75–2.0 with a ⅜ inch column with >99% recovery, and a $10^4$ separation from $^{90}Sr$, with <1% $^{90}Y$ remaining on the column after elution with concentrated $HNO_3$ solutions. It was found that DEHPA could be used on graphite felt in a similar manner as EHEHPA, but requires more concentrated acid to elute the $^{90}Y$. Determination of the optimal loading amounts for other extractants, and other substrates, may be readily determined by those of ordinary skill in the art.

Carbon or graphite felt has also been found to be a suitable substrate for bifunctional organophosphorus extracants such as CMPO. The CMPO is dissolved in methyl alcohol and dried on the substrate. Carbon or graphite fibers bind the CMPO strongly, and TBP is not needed to retain the CMPO. In an example of one embodiment of the invention, a column 0.325 inches diameter (8 mm) prepared from 15 graphite felt pads ⅛ inch thick loaded with 0.2 to 0.25 gram CMPO per gram of carbon or graphite felt is compressed to about 1.25 inches long. There is very little resistance to flow when the $^{90}Y$ in 8 N $HNO_3$ solution is loaded and washed with a total of about 30 ml 8 N $HNO_3$. The column is pulled dry with the pump. Because the impregnated felt is very hydrophobic, water is removed efficiently from the column. The $^{90}Y$ is eluted at a flow rate of 0.5 ml/minute with a minimum of eluant, 3–8 ml. In practice, about 15 ml is used. The eluant is passed though a small (0.325 inch diameter, 1.0-inch long column of XAD-4 to insure removal of any organic and filtered in line with a 0.45 micron filter to remove any particulates. Eluants successfully used in this manner included dilute hydrochloric acid, for example, 0.05 N HCl, dilute nitric acid, for example about 0.01 to about 0.05N $HNO_3$, water, 0.9% NaCl, and various concentrations of ammonium acetate solution. Many other eluants that would be compatible with biochemical solutions can be used as well.

Thus, in a preferred embodiment of the present invention, a generator system comprised of two columns packed with organic extractant can separate yttrium-90 from stronium-90. The chromatographic extraction system used in the generator consists of an ion exchange column containing acidic organophosphorus extractants such as DEHPA, EHEHPA, or DTMPPA, in flow communication with a second column that contains a second ion exchange comprising a bifuctional organophosphorus extractant such as CMPO or a neutral organophosphorous extractants such as TBP (tri-n-butyl phosphate). Lightweight porous chemically inert carbon or graphite felt is used to absorb the organic extractant and serve as a column matrix. In the separation process, about 0.2M $^{90}Sr(NO_3)_2$ nitrate solution at about pH 1.75 is loaded onto an EHEHPA column. $^{90}Sr$ ions pass through immediately, but $^{90}Y$ ions are retained. The $^{90}Sr$ solution is collected and stored in a shielded container for $^{90}Y$ grow-in for subsequent separation. After rinses with nitric solution at a pH of about 1.75, the $^{90}Y$ is eluted with a concentrated acid, such as about 8N $HNO_3$, and passed onto the second column that is connected in series. The eluted $^{90}Y$ ions are retained on second ion exchange in the second column and are further rinsed with additional concentrated acid. The $^{90}Y$ ions are then eluted with a dilute acid, such as about 0.01N $HNO_3$, or an ammonium acetate buffer. Both pH 1.75 and 8N nitric acid wash solutions are separated for any residual $^{90}Sr$. The decontamination factor for each column is greater than about $10^4$. The $^{90}Sr/^{90}Y$ ratio in the second eluant is in the range of about $10^{-8}$ at time of production date. The $^{90}Y$ obtained from the above separation has been shown to be of high chemical and radionuclidic purity and can be used for labeling targeted molecules having bearing chelators such as EDTA, DTPA and DOTA.

Other acidic organophosphorus extractants such as DEHPA and DTMPPA were also tested to separate $^{90}Y$ from $^{90}Sr$. The separation of $^{90}Y$ from $^{90}Sr$ could be achieved at pH about 1, about 2 and about 3 when DEHPA, EHEHPA and DTMPPA were used, respectively, which are consistent with the acidic strength of DEHPA, EHEHPA and DTMPPA.

The elution of $^{90}Y$ activity from the column was quantitatively similar regardless of which organic extractant was used. It is also preferable to use about 8N $HNO_3$ to elute $^{90}Y$ off an EHEHPA column and retain it on CMPO column, as any less concentrated $HNO_3$ may result in some loss of $^{90}Y$ in both columns.

There are several advantages of the process and apparatus of the present invention over known extracting processes in this field. Firstly, the contact time between the $^{90}Y$ activity and organic extractant is short, thus eliminating radiolytic breakdown of organic extractant. Secondly, graphite felt is a better absorbent than polymeric resin due to high resistance toward both chemical and radiation damage. Thirdly, because EHEHPA retains $^{90}Y$ at about pH 1.75 $HNO_3$ and CMPO retains $^{90}Y$ with concentrated $HNO_3$, the separation is a continuous process and there is no pH adjustment and volume concentration between the two organic extraction columns, which further reduce the process time. Fourthly, no organic solvent is involved in the disclosed process and much less aqueous radio-waste is also generated.

The quality of $^{90}Y$ obtained from the above process is suitable for therapeutic applications. The decontamination factor of both EHEHPA and CMPO column is in the order of about $10^4$ and the overall process can achieve an about $10^8$ decontamination factor. ICP analyses show low metal ions contamination. The radiochemical purity of $^{90}Y$ radiolabeling of DOTA derived biological molecule is equivalent to that of commercial $^{90}Y$ activity.

Another embodiment of the present invention involves a generator system and method for providing $^{201}Tl$. $^{201}Tl$ may be provided by radioactive decay of $^{201}Pb$. We have discovered that acidic organophosphorus extractants, such as DEHPA, EHEHPA, and DTMPPA have a strong affinity for $^{201}Pb$, but not for $^{201}Tl$, at pH greater than or equal to about 2.5. Thus, an embodiment of the present invention is provided that comprises a chromatographic column that contains an acidic organophosphorus extractant impregnated on a carbon or graphite substrate, as described elsewhere herein. When loaded with a solution of $^{201}Pb$ having a pH greater than or equal to about 2.5, the $^{201}Pb$ is retained on the column. As $^{201}Tl$ is generated by the decay of the parent isotope, it is released from the extractant into solution. The system is allowed to decay for a time sufficient to provide a predetermined portion of $^{201}Tl$, and then rinsed with an aqueous solution having a pH greater than or equal to about 2.5. Suitable rinses include, inter alia, water, dilute hydrochloric or nitric acid, or any biocompatible buffer solution. Preferably, an about 0.9% NaCl solution at about pH 5.5 is used. The efficiency of this generator system, and the fact that $^{201}Tl$ can be eluted simply with $H_2O$ or 0.9% NaCl, provide an advantage over any generator system for $^{201}Tl$ production described previously.

Another embodiment of the present invention involves a generator system and method for providing $^{99m}Tc$. $^{99m}Tc$ can be provided by radioactive decay of $^{99}Mo$. We have discovered that acidic organophosphorus extractants, such as DEHPA, EHEHPA, and DTMPPA have a strong affinity for $^{99}Mo$, but not for $^{99m}Tc$, at a pH from about 1 to about 2. Thus, an embodiment of the present invention is provided that comprises a chromatographic column that contains an acidic organophosphorus extractant impregnated on a carbon or graphite substrate, as described elsewhere herein. When loaded with a solution of $^{99}Mo$ having a pH from about 1 to about 2, the $^{99}Mo$ is retained on the column. As $^{99m}Tc$ is generated by the decay of the parent isotope, it is released from the extractant into solution. The system is allowed to decay for a time sufficient to provide a predetermined portion of $^{99m}Tc$, and then rinsed with an aqueous solution having a pH from about 1 to about 2. The absorbed $^{99}Mo$, if desirable, can be readily released by a basic solution such as 0.1 N sodium hydroxide or ammonium hydroxide.

EXAMPLES

The invention is further demonstrated in the following examples. All of the examples are actual examples. The examples are for purposes of illustration and are not intended to limit the scope of the present invention.

Example 1

Separation of $^{90}Y$ from a 17 mCi $^{90}Sr/^{90}Y$ Generator

After a 2 week $^{90}Y$ build-up 0.2 M $Sr(NO_3)_2$ pH 1.75 containing 17 mCi $^{90}Sr$ was loaded onto an EHEHPA column (0.1 g/g-wt. graphite felt) at 2.0 ml/min flow rate. The eluted $^{90}Sr$ ions were collected in a shielded container. The adsorbed $^{90}Y$ ions were washed with 30 ml $HNO_3$ pH 1.75 at 2.0 ml/min. The first 3 ml wash was added to the $^{90}Sr$ solution and the remaining wash solution was collected in a separate waste bottle for recycle of residual $^{90}Sr$. 15 ml of 8N $HNO_3$ was used to elute the adsorbed $^{90}Y$ from the EHEHPA column to a CMPO column (0.25 g/g-wt. graphite felt) at 0.5 ml/min. An additional 15 ml of 8 N $HNO_3$ was used to rinse the CMPO column. 15 ml of 0.01N $HNO_3$ at 0.5 ml/min was used to elute $^{90}Y$ and 15.77 mCi was collected. The 8N $HNO_3$ load or wash solutions did not contain any $^{90}Y$.

Example 2

Separation of $^{85}Sr$ 0.2M $Sr(NO_3)_2$ pH 1.75 containing 2.22 mCi $^{85}Sr$ was loaded onto an EHEHPA column (0.1 g/g-wt. graphite felt) at 2.0 ml/min flow rate. 2.17 mCi $^{85}Sr$ was eluted and collected in a shielded container. The EHEHPA column washed with 30 ml $HNO_3$ pH 1.75 at 2.0 ml/min, the first 3 ml wash was counted and contained 0.047 mCi $^{85}Sr$ (~2%); 0.0021 mCi (~0.1%) in the next 12 ml wash and 0.0002 mCi (~0.01%) in the following 15 ml wash. 15 ml of 8N $HNO_3$ was used to elute the EHEHPA column to a CMPO column (0.25 g/g-wt. graphite felt) at 0.5 m/min. An additional 15 ml of 8N $HNO_3$ was used to rinse the CMPO column. Finally 15 ml of 0.01 N $HNO_3$ at 0.5 ml/min was used to elute the CMPO column. There was no detectable $^{85}Sr$ activity in the CMPO column washes.

Example 3

Separation of $^{90}Y$ 0.2M $Sr(NO_3)_2$ pH 1.75 containing 1.31 mCi $^{90}Y$ was loaded onto an EHEHPA column (0.1 g/g-wt. graphite felt) at 2.0 ml/min flow rate. The $Sr(NO_3)_2$ solution was collected and had no $^{90}Y$. The adsorbed $^{90}Y$ on the EHEHPA were rinsed with 30 ml $HNO_3$ pH 1.75 at 2.0 m/min. The wash solution contained no $^{90}Y$. 15 ml of 8N $HNO_3$ was used to elute the adsorbed $^{90}Y$ from the EHEHPA column to a CMPO column (0.25 g/g-wt. graphite felt) at 0.5 ml/min. An additional 15 ml of 8N $HNO_3$ was used to rinse the CMPO column. Neither the load nor wash 8N $HNO_3$ contained any $^{90}Y$. 15 ml of 0.5M sodium acetate pH 6 at 0.5 ml/min was used to elute the 1.0 mCi of $^{90}Y$ collected.

Example 4

Separation of $^{90}Y$ from a 6.5 Ci $^{90}Sr/^{90}Y$ generator

After a 1 week $^{90}Y$ build-up 0.2M $Sr(NO_3)_2$ pH 1.75 containing 6.5 Ci $^{90}Sr$ was loaded onto an EHEHPA column (0.1 g/g-wt. graphite felt) at 2.0 ml/min flow rate. The eluted $^{90}$Sr were collected in a shielded container. The adsorbed $^{90}$Y were washed with 30 ml $HNO_3$ pH 1.75 at 2.0 ml/min. 15 ml of 8N $HNO_3$ was used to elute the adsorbed $^{90}$Y from the EHEHPA column to a CMPO column (0.25 g/g-wt. graphite felt) at 0.5 ml/min. An additional 15 ml of 8N $HNO_3$ was used to rinse the CMPO column. 15 ml of 0.01N $HNO_3$ at 0.5 ml/min was used to elute $^{90}$Y and 4.9 Ci was collected. The ratio of $^{90}$Sr to $^{90}$Y in the product was ~$10^{-8}$.

Example 5

Extraction of Tl-201 with DEHPA Column

DEHPA (10 pads, 0.325" in diameter, 0.6 g/g graphite) was packed in a 0.75"×2.75" glass column and followed by conditioned with 5 mL pH 2.5 and blown dry with 5 mL air. 200 uCi of $^{201}$Tl was added to 10 mL of pH 2.5 nitric acid. The pH of the $^{201}$Tl solution was measured and adjusted to pH 2.5 with NaOH. There was no $^{201}$Tl retained in the column after 10 ml loading followed by 10 ml water wash at 2 mL/min flow rate pumped with peristaltic pump. No $^{201}$Tl is retained in the column at other pH, such as 3, 4 and 5.

Example 6

Extraction of Pb-203 with DEHPA Column

DEHPA (10 pads, 0.325" in diameter, 0.6 g/g graphite) was packed in a 0.75"×2.75" glass column followed conditioned with 5 mL pH 2.5 nitric acid and blown dry with 5 mL air. 80 uCi of $^{203}$Pb was added to 10 mL of pH 2.5 nitric acid, pH of $^{203}$Pb solution was measured and adjusted to pH 2.5 with NaOH. ~80 uCi of $^{203}$Pb retained in the column after 10 ml loading, followed by 10 ml water wash at 2 mL/min flow rate pumped with a peristaltic pump. Similar results were seen at other pH, such as 3, 4 and 5. Less than 80 uCi of $^{203}$Pb was adsorbed in the column when pH is less than 2.

Example 7

Elution of Daughter Tl-201 from Tl-201 Generator

A $^{201}$Tl generator was prepared by loading 20 mL of pH 2.5 nitric acid containing aliquot of irradiated $^{203}$Tl target solution on a DEHPA column (10 pads, 0.325" in diameter, 0.6 g/g graphite), followed by rinsing the column with 20 mL of water. Flow rate was kept at 2 mL/min in the column preparation. The irradiated $^{203}$Tl target solution comprises 20 uL $^{201}$Pb solution (~2.38 mCi of Pb-201, determined by Ge (Li)). Eighteen hours later, 221 uCi of $^{201}$Tl was collected in 40 mL of water eluant. Additional 24 hours later, 56 uCi of $^{201}$Tl was collected in 40 mL of water eluant from the same generator.

Example 8

Extraction of $^{99}$Mo with EHEHPA

A $^{99}$Mo solution was prepared by adding 0.5 ml pH 3 $^{99}$Mo containing 0.94 mCi to 20 ml 0.1N $HNO_3$. The mixture was loaded onto a 2.5 inch glass column packed with 12 pads of graphite felt laced with EHEHPA (0.1 g EHEHPA/g of graphite) at a 5 ml/min flow rate. After loading of the $^{99}$Mo activity, 10 ml 0.1N $HNO_3$ was used to rinse the EHEHPA column. 0.83 and 0.02 mCi of $^{99m}$Tc activity were collected in load and wash fractions respectively. Ge(Li) analysis determined about 0.02 mCi $^{99}$Mo was mixed with $^{99m}$Tc eluates.

Example 9

Extraction of $^{99}$Mo with DEHPA

A $^{99}$Mo solution was prepared by mixing 6 mg molybdenum ion and 97 uCi $^{99}$Mo in 20 ml 0.1N $HNO_3$. The mixture was loaded onto a DEHPA/graphite column (1.0 g DEHPA/g of graphite) at a 5 ml/min flow rate and 97 uCi of $^{99m}$Tc activity was collected. Similar results were obtained when no cold molybdenum ion was used. This example demonstrates than an excess of cold molybdenum ion did not interfere with the binding of $^{99}$Mo.

Example 10

Extraction of $^{99}$Mo with DEHPA

A $^{99}$Mo solution was prepared by adding 0.1 ml pH 3 $^{99}$Mo containing 1.01 mCi to 20 ml 0.1N $HNO_3$. The mixture was loaded onto a 2.5 inch glass column packed with 12 pads of graphite felt laced with DEHPA (0.2 g DEHPA/g of graphite) at a 5 ml/min flow rate. After loading of the $^{99}$Mo activity, 20 ml 0.1N $HNO_3$ was used to rinse the DEHPA column. 0.993 and 0.037 mCi of $^{99m}$Tc activity were collected in load and wash fraction respectively. The column was eluted again after 23 hours and 0.65 mCi (~94% yield) of $^{99m}$Tc was obtained.

All publications, patents, and patent documents cited herein are incorporated herein by reference for all purposes, as though individually incorporated by reference. The invention has been described with reference to various specific and preferred embodiments and techniques. It should be understood, however, that many variations and modifications might be made while remaining within the spirit and scope of the invention.

What is claimed is:

1. A $^{99m}$Tc generator comprising:

(a) a body portion having an inlet and an outlet; and (b) an ion exchange housed within said body portion, said ion exchange comprising carbon or graphite fibers impregnated with an acidic organophosphorus extractant selected from the group consisting of DEHPA, EHEHPA, and DTMPPA, and said ion exchange further comprising ions of $^{99}$Mo bound to said extractant.

2. A $^{99m}$Tc generator according to claim 1, further comprising:

(c) an aqueous solution having a pH of from about 1 to about 2 within said body portion and in contact with said ion exchange, said aqueous acid solution containing $^{99m}$Tc that has been produced by radioactive decay of said $^{99}$Mo.

3. A $^{99m}$Tc generator according to claim 2, wherein the pH of said aqueous solution is about 1.

4. A $^{99m}$Tc generator according to claim 2, wherein the pH of said aqueous solution is about 2.

5. A $^{99m}$Tc generator according to claim 2, wherein said aqueous solution is selected from the group consisting of hydrochloric acid and nitric acid.

6. A $^{99m}$Tc generator according to claim 1, wherein said acidic organophosphorus extractant comprises DEHPA.

7. A $^{99m}$Tc generator according to claim 1, wherein said acidic organophosphorus extractant comprises EHEHPA.

* * * * *